US008230926B2

(12) United States Patent
Rogers et al.

(10) Patent No.: US 8,230,926 B2
(45) Date of Patent: Jul. 31, 2012

(54) MULTIPLE STAGE CEMENTING TOOL WITH EXPANDABLE SEALING ELEMENT

(75) Inventors: Henry E. Rogers, Duncan, OK (US); Steven L. Holden, Fletcher, OK (US); Alan T. Jackson, Frisco, TX (US)

(73) Assignee: Halliburton Energy Services Inc., Duncan, OK (US)

( * ) Notice: Subject to any disclaimer, the term of this patent is extended or adjusted under 35 U.S.C. 154(b) by 336 days.

(21) Appl. No.: 12/721,990

(22) Filed: Mar. 11, 2010

(65) Prior Publication Data

US 2011/0220356 A1 Sep. 15, 2011

(51) Int. Cl.
*E21B 33/14* (2006.01)

(52) U.S. Cl. ..... 166/289; 166/212

(58) Field of Classification Search ..... 166/289, 166/212, 217; 277/339; 72/56–58
See application file for complete search history.

(56) References Cited

U.S. PATENT DOCUMENTS

| | | | | | |
|---|---|---|---|---|---|
| 2,925,865 | A | | 2/1960 | Oliver | |
| 3,011,555 | A | * | 12/1961 | Clark, Jr. | 166/122 |
| 3,524,503 | A | * | 8/1970 | Baker | 166/289 |
| 3,768,556 | A | | 10/1973 | Baker | |
| 4,573,537 | A | * | 3/1986 | Hirasuna et al. | 166/387 |
| 4,842,082 | A | * | 6/1989 | Springer | 175/279 |
| 5,024,273 | A | * | 6/1991 | Coone et al. | 166/289 |
| 5,038,862 | A | | 8/1991 | Giroux et al. | |
| 5,178,216 | A | | 1/1993 | Giroux et al. | |
| 5,277,253 | A | | 1/1994 | Giroux et al. | |
| 5,279,370 | A | | 1/1994 | Brandell et al. | |
| 5,314,015 | A | | 5/1994 | Streich et al. | |
| 5,526,878 | A | | 6/1996 | Duell et al. | |
| 5,641,021 | A | | 6/1997 | Murray et al. | |
| 6,568,471 | B1 | | 5/2003 | Cook et al. | |
| 6,622,798 | B1 | | 9/2003 | Rogers et al. | |
| 6,651,743 | B2 | | 11/2003 | Szarka | |
| 6,712,154 | B2 | | 3/2004 | Cook et al. | |
| 7,086,479 | B2 | | 8/2006 | Schultz et al. | |
| 7,100,684 | B2 | | 9/2006 | Cook et al. | |
| 7,100,685 | B2 | | 9/2006 | Cook et al. | |
| 7,121,352 | B2 | | 10/2006 | Cook et al. | |
| 7,185,710 | B2 | | 3/2007 | Cook et al. | |

(Continued)

OTHER PUBLICATIONS

U.S. Appl. No. 12/544,554 titled Internal Retention Mechanism, filed Aug. 2, 2009, Henry E. Rogers, et al., inventors.

(Continued)

*Primary Examiner* — Jennifer H Gay
*Assistant Examiner* — Blake Michener
(74) *Attorney, Agent, or Firm* — John W. Wustenberg; McAfee & Taft

(57) ABSTRACT

A cementing tool for cementing a casing in a well has an inner mandrel that defines a central flow passage and has at least one fluid port defined through a wall thereof. An outer mandrel is disposed about the inner mandrel and the inner and outer mandrels define an annular space therebetween. The outer mandrel has at least one sealing element affixed thereto. An opening sleeve is positioned in the inner mandrel and is movable from a closed position to an open position in which the fluid port is uncovered. An expansion cone is positioned in the annular space. Fluid pressure applied through the central flow passage, and the fluid port will pass into the annular space and will urge the expansion cone through the annular space which will plastically deform the outer mandrel so that sealing elements affixed to the outer mandrel engage a previously installed casing in the well to seal thereagainst.

20 Claims, 5 Drawing Sheets

U.S. PATENT DOCUMENTS

| | | | | |
|---|---|---|---|---|
| 7,195,064 | B2 | 3/2007 | Cook et al. | |
| 7,234,531 | B2 | 6/2007 | Kendziora et al. | |
| 7,243,731 | B2 | 7/2007 | Watson et al. | |
| 7,258,168 | B2 | 8/2007 | Cook et al. | |
| 7,290,605 | B2 | 11/2007 | Waddell et al. | |
| 7,290,616 | B2 | 11/2007 | Cook et al. | |
| 7,350,563 | B2 | 4/2008 | Waddell et al. | |
| 7,350,564 | B2 | 4/2008 | Cook et al. | |
| 7,360,591 | B2 | 4/2008 | Ring | |
| 7,363,984 | B2 | 4/2008 | Brisco et al. | |
| 7,377,326 | B2 | 5/2008 | Shuster et al. | |
| 7,383,889 | B2 | 6/2008 | Ring et al. | |
| 7,398,832 | B2 | 7/2008 | Brisco | |
| 7,404,444 | B2 | 7/2008 | Costa et al. | |
| 7,410,000 | B2 | 8/2008 | Cook et al. | |
| 7,416,027 | B2 | 8/2008 | Ring et al. | |
| 7,424,918 | B2 | 9/2008 | Shuster et al. | |
| 7,438,133 | B2 | 10/2008 | Brisco | |
| 7,503,393 | B2 | 3/2009 | Shuster et al. | |
| 7,506,687 | B2 | 3/2009 | Ring | |
| 7,513,313 | B2 | 4/2009 | Watson et al. | |
| 7,516,790 | B2 | 4/2009 | Cook et al. | |
| 7,546,881 | B2 | 6/2009 | Lloyd et al. | |
| 7,552,776 | B2 | 6/2009 | Noel | |
| 7,556,092 | B2 | 7/2009 | Cook et al. | |
| 7,559,365 | B2 | 7/2009 | Watson et al. | |
| 2003/0034177 | A1 | 2/2003 | Chitwood et al. | |
| 2003/0106689 | A1 | 6/2003 | Nguyen | |
| 2004/0123983 | A1 | 7/2004 | Cook et al. | |
| 2004/0134662 | A1 | 7/2004 | Chitwood et al. | |
| 2004/0136784 | A1 | 7/2004 | Dahlem et al. | |
| 2004/0244982 | A1 | 12/2004 | Chitwood et al. | |
| 2005/0028988 | A1* | 2/2005 | Cook et al. | 166/380 |
| 2005/0103502 | A1 | 5/2005 | Watson et al. | |
| 2005/0123639 | A1 | 6/2005 | Ring et al. | |
| 2005/0241834 | A1 | 11/2005 | McGlothen et al. | |
| 2006/0048948 | A1 | 3/2006 | Noel | |
| 2006/0054330 | A1 | 3/2006 | Ring et al. | |
| 2006/0065403 | A1 | 3/2006 | Watson et al. | |
| 2006/0086502 | A1 | 4/2006 | Reddy et al. | |
| 2006/0086503 | A1 | 4/2006 | Reddy et al. | |
| 2006/0118192 | A1 | 6/2006 | Cook | |
| 2006/0137877 | A1 | 6/2006 | Watson et al. | |
| 2006/0196679 | A1 | 9/2006 | Brisco et al. | |
| 2006/0208488 | A1 | 9/2006 | Costa | |
| 2006/0213668 | A1 | 9/2006 | Cook et al. | |
| 2006/0225892 | A1 | 10/2006 | Watson et al. | |
| 2006/0266527 | A1 | 11/2006 | Brisco et al. | |
| 2006/0272826 | A1 | 12/2006 | Shuster et al. | |
| 2006/0283603 | A1 | 12/2006 | Shuster et al. | |
| 2007/0029095 | A1 | 2/2007 | Brisco et al. | |
| 2007/0039742 | A1 | 2/2007 | Costa | |
| 2007/0051520 | A1 | 3/2007 | Parker | |
| 2007/0056743 | A1 | 3/2007 | Costa | |
| 2007/0144735 | A1 | 6/2007 | Lloyd et al. | |
| 2007/0151360 | A1 | 7/2007 | Ring et al. | |
| 2007/0163785 | A1 | 7/2007 | Shuster et al. | |
| 2007/0169944 | A1 | 7/2007 | Parker et al. | |
| 2007/0175630 | A1 | 8/2007 | Costa et al. | |
| 2007/0205001 | A1 | 9/2007 | Shuster et al. | |
| 2007/0215360 | A1 | 9/2007 | Shuster et al. | |
| 2007/0227730 | A1 | 10/2007 | Brisco et al. | |
| 2007/0246934 | A1 | 10/2007 | Heertjes et al. | |
| 2007/0266756 | A1 | 11/2007 | Shuster et al. | |
| 2007/0272419 | A1 | 11/2007 | Costa et al. | |
| 2007/0277972 | A1 | 12/2007 | Shuster et al. | |
| 2007/0278788 | A1 | 12/2007 | Costa | |
| 2007/0289818 | A1 | 12/2007 | Butterfield | |
| 2008/0000645 | A1 | 1/2008 | Brisco et al. | |
| 2008/0018099 | A1 | 1/2008 | Costa | |
| 2008/0023194 | A1 | 1/2008 | Noel et al. | |
| 2008/0035251 | A1 | 2/2008 | Brisco et al. | |
| 2008/0041584 | A1 | 2/2008 | Reddy et al. | |
| 2008/0041585 | A1 | 2/2008 | Reddy et al. | |
| 2008/0041591 | A1 | 2/2008 | Reddy et al. | |
| 2008/0042428 | A1 | 2/2008 | Costa | |
| 2008/0066926 | A1 | 3/2008 | Costa et al. | |
| 2008/0066929 | A1 | 3/2008 | Costa et al. | |
| 2008/0083541 | A1 | 4/2008 | Butterfield, Jr. et al. | |
| 2008/0093068 | A1 | 4/2008 | Waddell et al. | |
| 2008/0093089 | A1 | 4/2008 | Waddell et al. | |
| 2008/0100064 | A1 | 5/2008 | Costa | |
| 2008/0104823 | A1 | 5/2008 | Shuster et al. | |
| 2008/0115931 | A1 | 5/2008 | Shuster | |
| 2008/0136181 | A1 | 6/2008 | Costa | |
| 2008/0142213 | A1 | 6/2008 | Costa et al. | |
| 2008/0142229 | A1 | 6/2008 | Brisco et al. | |
| 2008/0144759 | A1 | 6/2008 | Cook et al. | |
| 2008/0149343 | A1 | 6/2008 | Chitwood et al. | |
| 2008/0236230 | A1 | 10/2008 | Brisco et al. | |
| 2008/0257542 | A1 | 10/2008 | Brisco et al. | |
| 2009/0001721 | A1 | 1/2009 | Costa et al. | |
| 2009/0014172 | A1 | 1/2009 | Costa et al. | |
| 2009/0038138 | A1 | 2/2009 | Costa | |
| 2009/0065196 | A1 | 3/2009 | Holland et al. | |
| 2009/0090516 | A1 | 4/2009 | DeLucia et al. | |
| 2009/0126944 | A1 | 5/2009 | Noel, Jr. | |
| 2009/0193871 | A1 | 8/2009 | Brisco et al. | |
| 2009/0205839 | A1 | 8/2009 | Cook et al. | |
| 2009/0229836 | A1 | 9/2009 | DeLucia | |
| 2009/0301733 | A1 | 12/2009 | Shuster et al. | |
| 2009/0302604 | A1 | 12/2009 | Costa | |
| 2009/0308656 | A1 | 12/2009 | Chitwood et al. | |
| 2010/0024348 | A1 | 2/2010 | Brisco et al. | |
| 2010/0044030 | A1 | 2/2010 | Whiddon et al. | |
| 2010/0051276 | A1* | 3/2010 | Rogers et al. | 166/289 |
| 2010/0206572 | A1* | 8/2010 | Makowiecki et al. | 166/332.1 |

OTHER PUBLICATIONS

U.S. Appl. No. 12/371,374 titled Stage Cementing Tool, filed Feb. 13, 2009, Gary J. Makowiecki, et al. inventors.

U.S. Appl. No. 12/231,714 titled Stage Cementing Tool, filed Sep. 4, 2008, Henry E. Rogers, et al., inventors.

Weatherford International Ltd., Houston, TX, flyer titled "POST (TM) Pack-Off Stage Tool" (2008).

Halliburton Company Sales and Service Catalog, pp. 42 and 43 (1964).

Images from Halliburton Sales Manual (5 sheets) (undated but admitted to be prior art).

* cited by examiner

MULTIPLE STAGE CEMENTING TOOL WITH EXPANDABLE SEALING ELEMENT

BACKGROUND OF THE INVENTION

The present invention relates generally to casing valves for use in the casing of a well, and more particularly, but not by way of limitation, to cementing tools constructed for placement in a well casing.

In the drilling of deep wells, it is often desirable to cement the casing in the wellbore in separate stages, beginning at the bottom of the well and working upward.

This process is achieved by placing cementing tools, which are primarily valved ports, in the casing or between joints of casing at one or more locations in the wellbore, flowing cement through the bottom of the casing, up the annulus to the lowest cementing tool, closing off the bottom, opening the cementing tool, and then flowing cement through the cementing tool up the annulus to the next upper stage and repeating this process until all stages of cementing the well are completed.

Cementing tools are shown, for example, in U.S. Pat. Nos. 5,038,862, 5,314,015, 5,526,878 and 3,768,556. Cementing tools often utilize sealing elements to seal between the tool and the wellbore or well casing prior to displacing cement into the well through the tool. For example, many such tools use inflatable packers to seal against the well. Oftentimes, however, inflatable packers have a limited flow area to accommodate the weighted solid laden inflation fluid and do not fully inflate. The result is that the inflatable packer will not hold as much hydraulic pressure as desired. It may be necessary in such situations to wait until the cement below the tool sets up, which is a time-consuming, and therefore costly process. There is a continuing need for stage cementing tools that can be reliably set in the well, to provide for immediate cementing of casing above the tool, with no need to wait for cement therebelow to harden.

SUMMARY

A cementing tool for cementing a casing in a well comprises an inner mandrel and an outer mandrel disposed thereabout. An annular space is defined between the inner and outer mandrels. The inner mandrel defines a central flow passage and has at least one fluid port through a wall thereof. At least one sealing element and preferably a plurality of sealing elements are affixed to the outer mandrel. An opening sleeve detachably connected in the inner mandrel is movable from a closed position in which the opening sleeve covers the at least one fluid port to an open position in which the at least one fluid port is uncovered. The opening sleeve may be moved for example by a plug dropped through the casing used to lower the cementing tool into the well. Fluid pressure communicated through the at least one fluid port from the central flow passage into the annular space will cause the outer mandrel to radially expand, and preferably to plastically deform radially outwardly so that the at least one sealing element engages a previously installed casing in the well.

An expansion cone is positioned in the annular space between the inner and outer mandrel. The fluid communicated through the fluid port will force the expansion cone through the annular space. The expansion cone has a width greater than a width of a first portion of the annular space so that the outer mandrel will radially expand and plastically deform to engage the well. Because the outer mandrel plastically deforms it will maintain a sealing engagement with the well and will create a hydraulic seal such that cementing thereabove can occur. The cement flowed through the central flow passage, the fluid port and the annular space will pass through an upper end of the annular space and will fill an annulus between the casing used to lower the cementing tool in the well and the previously installed casing. The cementing process can occur prior to the time the cement utilized to cement a casing in the wellbore below the previously installed casing hardens. Cement will pass through an upper end of the annular space after it pushes or expels the expansion cone through the upper end thereof.

The method of cementing may therefore comprise lowering a cementing tool into the well on a casing and plastically deforming a portion of the tool so that it engages a previously installed casing in the well. The method further comprises pumping cement through the cementing tool into an annulus between the previously installed casing and the casing used to lower the cementing tool in the well. The plastically deforming step may comprise pumping fluid through an annular space defined between the inner mandrel and the outer mandrel to urge an expansion cone disposed in the annular space through a first portion of the annular space. The plastically deforming step will occur after a casing portion attached to the lower end of the cementing tool is cemented in the well.

DESCRIPTION OF AN EMBODIMENT

Figure 1:
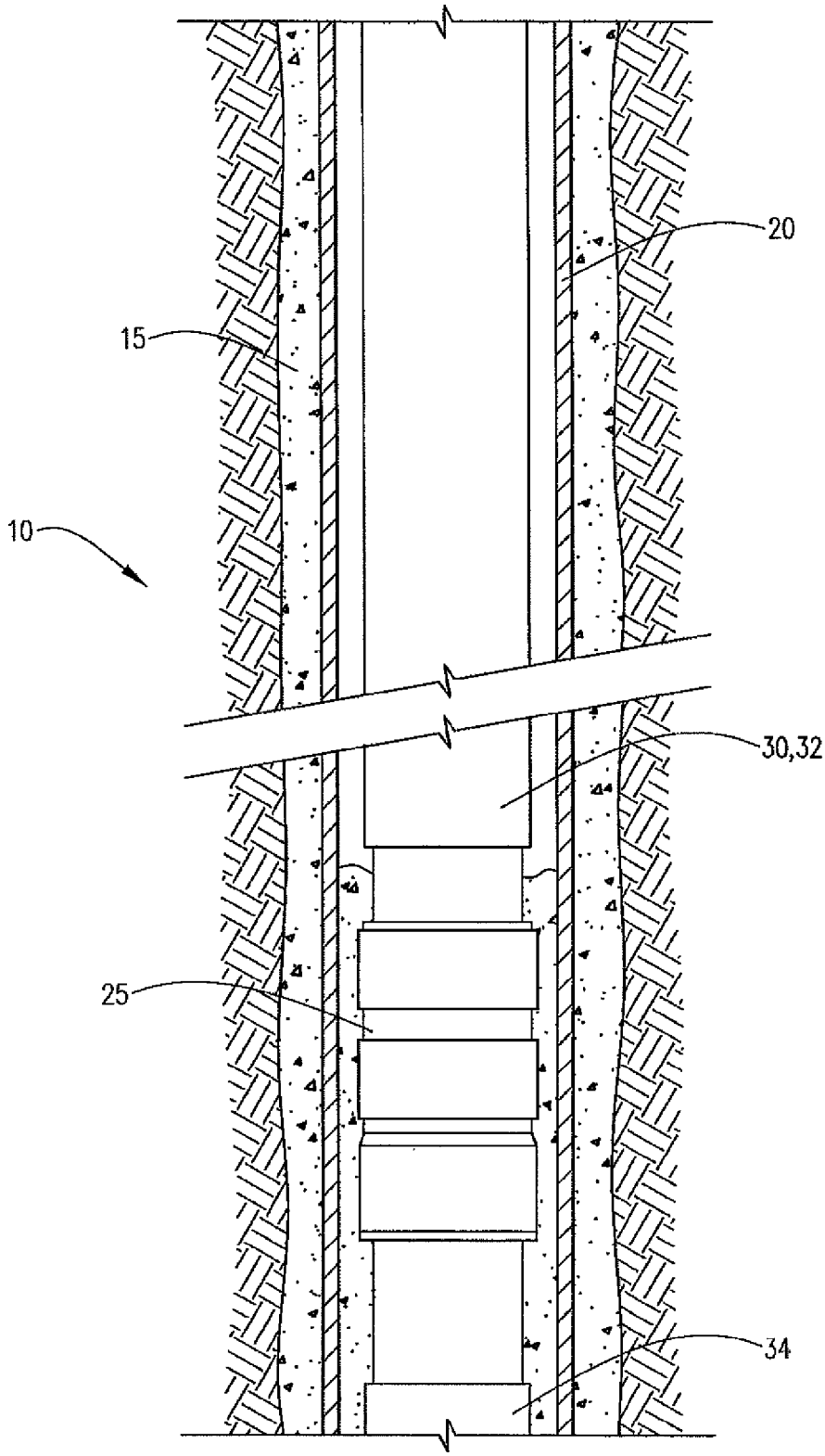
FIG. 1 schematically shows a tool lowered into a well.

As shown in FIG. 1 well 10 comprises a wellbore 15 with a casing 20 which may be referred to as a previously installed casing 20 cemented therein. A cementing tool 25 is lowered into casing 20 on a liner 30 which as is known in the art may be referred to as casing 30. Casing 30 has upper portion 32 and lower portion 34 with cementing tool 25 connected therebetween.

FIG. 1 shows the cement level above cementing tool 25. As known in the art, lower cementing portion 34 may have float equipment thereon, so that cement passes therethrough into wellbore 15. Cement is displaced therethrough to cement lower casing portion 34 in wellbore 15. When the level of the cement is at, or preferably above, cementing tool 25 as shown in FIG. 1, cement may be flowed through cementing tool 25 to cement upper casing portion 32 in well 10, and more specifically in previously installed casing 20. With cementing tool 25 it is not necessary to wait until the cement below tool 25 hardens. Thus, cementing of upper casing portion 32 can begin as soon as a desired amount of cement has been displaced through the lower end of casing 30 to cement the lower portion 34 in wellbore 15. FIG. 1 is representative of cementing tool 25 after such cementing has occurred, but prior to the time cementing tool 25 is expanded to seal against casing 20.

Referring now to FIGS. 2-5, cementing tool 25 comprises an inner mandrel 36 which defines a central flow passage 37 therethrough. An outer mandrel 38 is positioned about inner mandrel 36. Outer mandrel 38 and inner mandrel 36 define an annular space 40 therebetween. As will be explained in greater detail hereinbelow, fluid pressure communicated through flow passage 37 will be communicated into annular space 40 to cause the plastic deformation of outer mandrel 38 so that seals affixed thereto will engage previously installed casing 20 to seal thereagainst. Cementing may thus occur above cementing tool 25 to cement the upper portion 32 of casing 30 in the well, and cementing can occur prior to the time the cement around lower portion 34 hardens.

Inner mandrel 36 has upper end 42 adapted to be connected to a casing. For example, upper end 42 may be threaded so that a coupling 43 may be attached thereto which will then connect to upper portion 32 of casing 30. Lower end 44 of inner mandrel 36 is likewise adapted to be connected to a casing. For example, lower end 44 may have a thread on an outer surface thereof to connect to lower portion 34 of casing 30. It is understood that lower portion 34 may have a float collar or float shoe or other arrangement thereon whereby cement will pass through a lower end of lower portion 34 and into the annulus between wellbore 15 and lower portion 34. Cement will be displaced therethrough until a sufficient amount of cement is in the annulus and has filled the annulus to a location above annular space 40.

Mandrel 36 comprises upper portion 46 which may be referred to as the upper inner mandrel 46. Upper mandrel 46 has outer surface 47 and inner surface 49. Upper inner mandrel 46 is a generally cylindrical tube having upper end 42 which is the upper end of inner mandrel 36. Inner mandrel 36 comprises lower portion, or lower inner mandrel 48 having lower end 44. Lower inner mandrel 48 may also be referred to as a housing 48 to which sleeves utilized in the operation of cementing tool 25 are connected. Outer surface 47 defines an outer diameter 50 of upper inner mandrel 46. Inner surface 49 defines inner diameter 51. A lower end 52 of upper inner mandrel 46 is connected to an upper end 54 of lower inner mandrel 48.

A fluid port 56, which may be referred to as cementing port 56, is defined through inner mandrel 36 and preferably is defined through lower inner mandrel 48. In the embodiment disclosed, there are a plurality of fluid ports 56 defined through inner mandrel 36. Fluid ports 56, seen in FIGS. 3-5, communicate central flow passage 37 with annular space 40. An anchor ring 60 is connected in inner mandrel 36 and as shown is connected in lower inner mandrel 44. Anchor ring 60 is locked into position in lower inner mandrel 48 with a retainer ring 61 of a type known in the art such as is disclosed in U.S. Pat. No. 5,178,216 assigned to the assignee of the present invention. Retainer ring 61 is disposed in a retainer ring groove 62 in lower inner mandrel 48 and is radially outwardly biased by the natural spring resiliency of the retainer ring. At least a portion of retainer ring 61 is also disposed in a ring groove 64 defined in an outer surface of anchor ring 60. Retaining ring 61 is compressed so that it fits in groove 64, and so that it can pass through central flow passage 37. Retaining ring 61 will spring outwardly to engage ring groove 64. Retainer ring groove 62 and ring groove 64 are configured such that when axial forces are applied to anchor ring 60, retaining ring 61 cannot be forced out of ring groove 64, and anchor ring 60 will be held in inner mandrel 36.

An opening sleeve 66 is disposed, and preferably detachably connected in mandrel 36 and more specifically in lower inner mandrel 48. Likewise, an operating sleeve 68 is detachably connected in lower inner mandrel 48. A closing sleeve 70 is disposed in annular space 40 about lower inner mandrel 48. Lower inner mandrel 48 has operating slots 72 defined therein. A plurality of connectors 74 operably connect operating sleeve 68 with closing sleeve 70 so that downward movement of operating sleeve 72 will cause closing sleeve 70 to move downwardly.

Outer mandrel 38 has upper end 76 and lower end 78. A connecting sub 80 having threads on an outer surface 82 thereof and likewise on an inner surface 84 thereof connects outer mandrel 38 to inner mandrel 36 at the lower end 78 of outer mandrel 36. Connecting sub 80 may have a relief port 86 with a relief plug 88 inserted therein. Relief plug 88 may be removed to allow the release of fluid in annular space 40. A debris plug 90 is inserted in annular space 40 at the upper end 76 of outer mandrel 38 and closes off an upper end of the annular space 40.

Outer mandrel 38 has upper portion 92 and lower portion 94. Upper portion 92 defines an inner diameter 93. A transition or transition portion 96 extends between upper and lower or first and second portions 92 and 94. Outer mandrel 38 has an outer surface 98. Outer surface 98 comprises an outer surface 100 on the upper portion 92 of outer mandrel 38 and an outer surface 102 on the lower portion 94 thereof. In the run-in position shown in FIG. 2, outer surface 100 is positioned radially inwardly from outer surface 102.

Figures 2A, 2B:
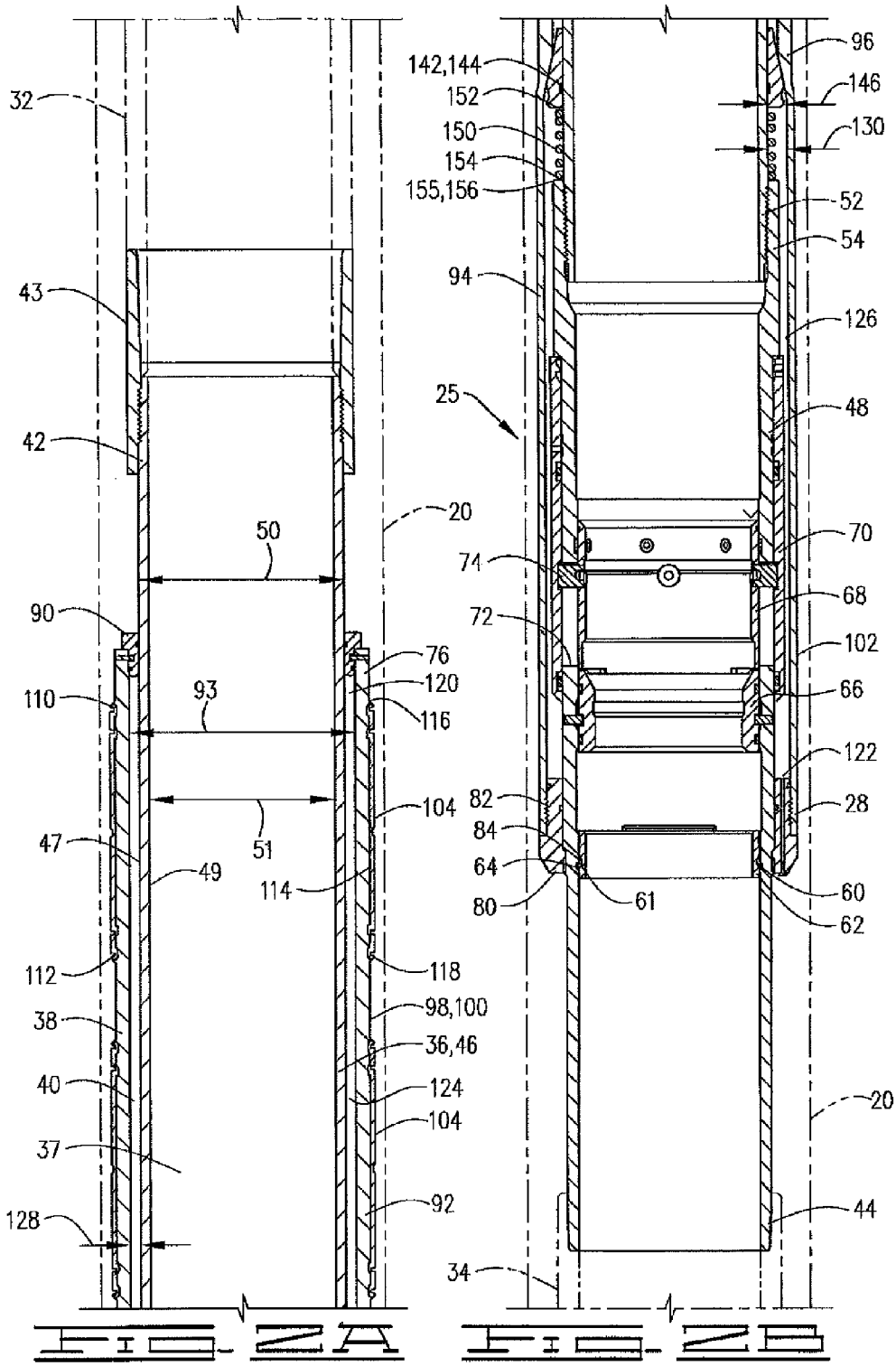
FIG. 2 is a cross section of the tool in a run-in position.
Figures 5A, 5B:
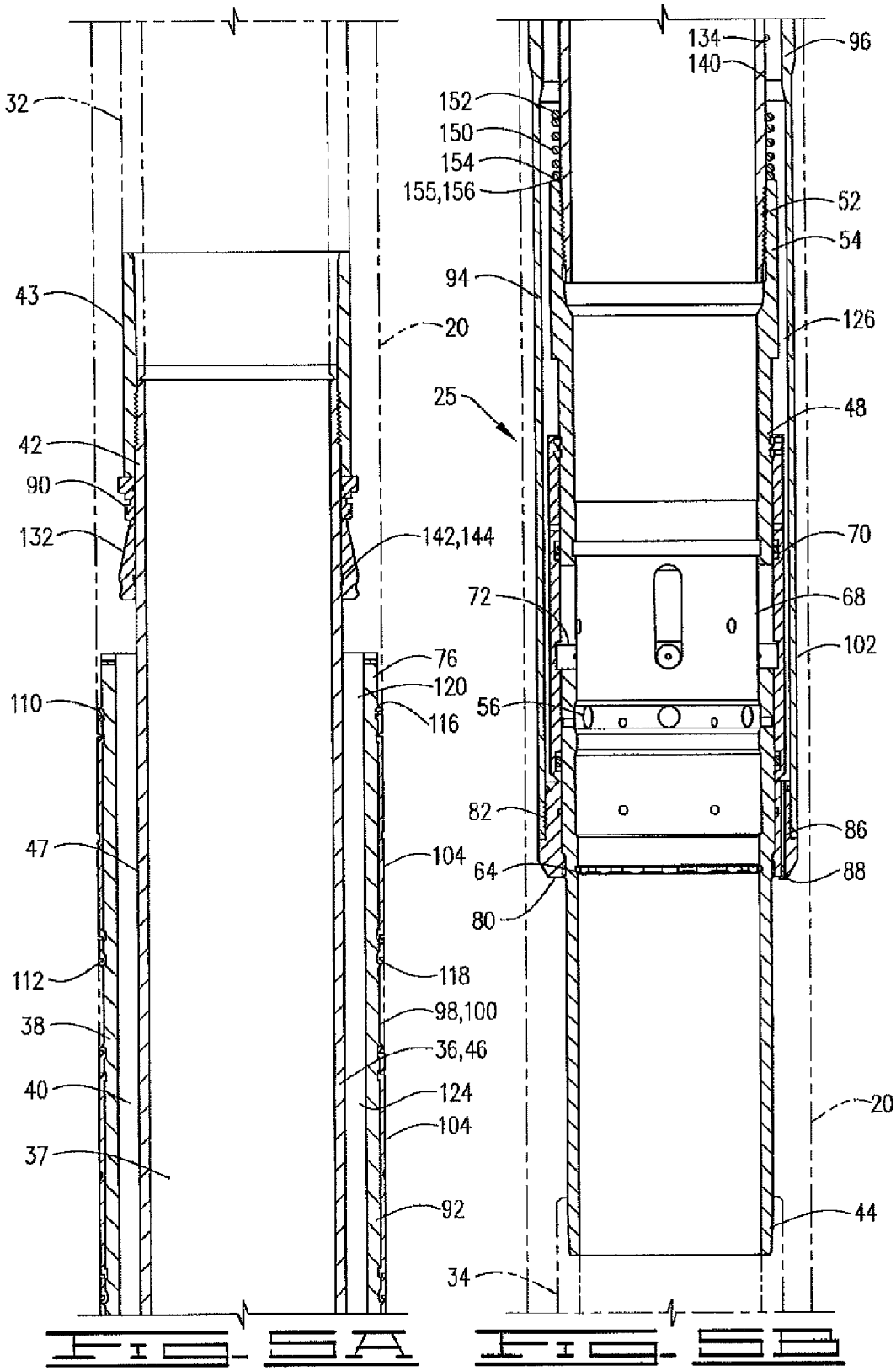
FIG. 5 is a cross section of the tool after cementing operations have been completed.

At least one and preferably a plurality of sealing elements 104 are disposed about outer mandrel 38. As shown in FIG. 2 sealing elements 104 are disposed about upper portion 92. Sealing elements 104 may be comprised of elastomeric material such as for example VITON® FKM (Vicon) FLOREL® or AFLAF. The examples provided herein are non-limiting. Sealing elements 104 are affixed to upper portion 92 of outer mandrel 38 and in a set position in a well as shown in FIGS. 4 and 5 will sealingly engage previously installed casing 20.

Each of sealing elements 104 has an upper end 110 and a lower end 112, and are mounted to a sealing portion 114 of outer mandrel 38. Sealing portion 114 may have a top ring 116 and a bottom ring 118 at the upper and lower ends 110 and 112 of sealing element 104. Top and bottom rings 116 and 118 may have sharp points that extend radially outwardly from outer surface 102. Sealing portion 114 may also include grooves 120 in outer surface 100 to assist in mounting sealing elements 104. Top and bottom rings 116 and 118 are preferably integrally fabricated with outer mandrel 38 and in the expanded position shown in FIGS. 4 and 5, top and bottom rings 116 and 118 engage previously installed casing 20. Top and bottom rings 116 and 118 will act as extrusion limiters which will prevent the sealing elements 104 from extruding out of mounting portion 114 and will help to assure an adequate hydraulic seal.

Annular space 40 has upper end 120 in which debris plug 90 is placed and has lower end 122. Annular space 40 comprises upper portion 124 and lower portion 126. Upper portion 124 has a width 128 prior to the plastic deformation of upper portion 92 of outer mandrel 38. A width 130 is defined by and between the lower portion 126 of annular space 40 and upper inner mandrel 46. An expansion cone 132 which may also be referred to as expansion wedge 132 is disposed about inner mandrel 36 and in the embodiment shown is disposed about upper inner mandrel 46. Expansion cone 132 has a leading edge 134 and angles radially outwardly therefrom to an outermost diameter 136. An inner surface 140 of expansion cone 132 engages outer surface 47 of upper inner mandrel 46. A groove 142 is defined in inner surface 140 and has a sealing ring which may be for example an O-ring 144 disposed therein so that expansion cone 132 sealingly engages upper inner mandrel 46.

The width 146 of expansion cone 132 at outermost diameter 136 is greater than the width 128 of the upper portion 124 of annular space 40 prior to plastic deformation of upper portion 92 of outer mandrel 38. Thus, in the run-in position outer diameter 136 is greater than the inner diameter 93 of upper portion 92 of outer mandrel 38. A biasing member, or spring 150 is disposed in annulus space 40 about inner mandrel 36. Spring 150 has an upper end 152 and a lower end 154. Upper end 152 engages expansion cone 132 and urges expansion cone 132 towards the first or upper portion 124 of annular space 40. Lower end 154 of spring 50 engages an upper end 155 of lower inner mandrel 48. Upper end 155 defines a shoulder 156 to provide an engagement surface for spring 150.

Expansion cone 132 in the position shown in FIG. 2 will engage outer mandrel 38 at the transition section 96 thereof since the width 146 of expansion cone 132 is greater than the width 128 of the upper portion 124 of annular space 40. Preferably, prior to the placement of debris plug 90, fluid is injected through upper portion 124 of annular space 40 into the lower portion 126 thereof. Fluid is injected therein with a fluid pressure sufficient to overcome the spring pressure applied by spring 150 and will force expansion cone 132 downwardly away from transition 96. Once the desired amount of fluid has been placed in lower portion 126 of annular space 40, fluid pressure is released and the spring 150 will urge expansion cone 132 upwardly so that it once again engages transition 96 on an inner surface of outer mandrel 38.

Figures 3A, 3B:
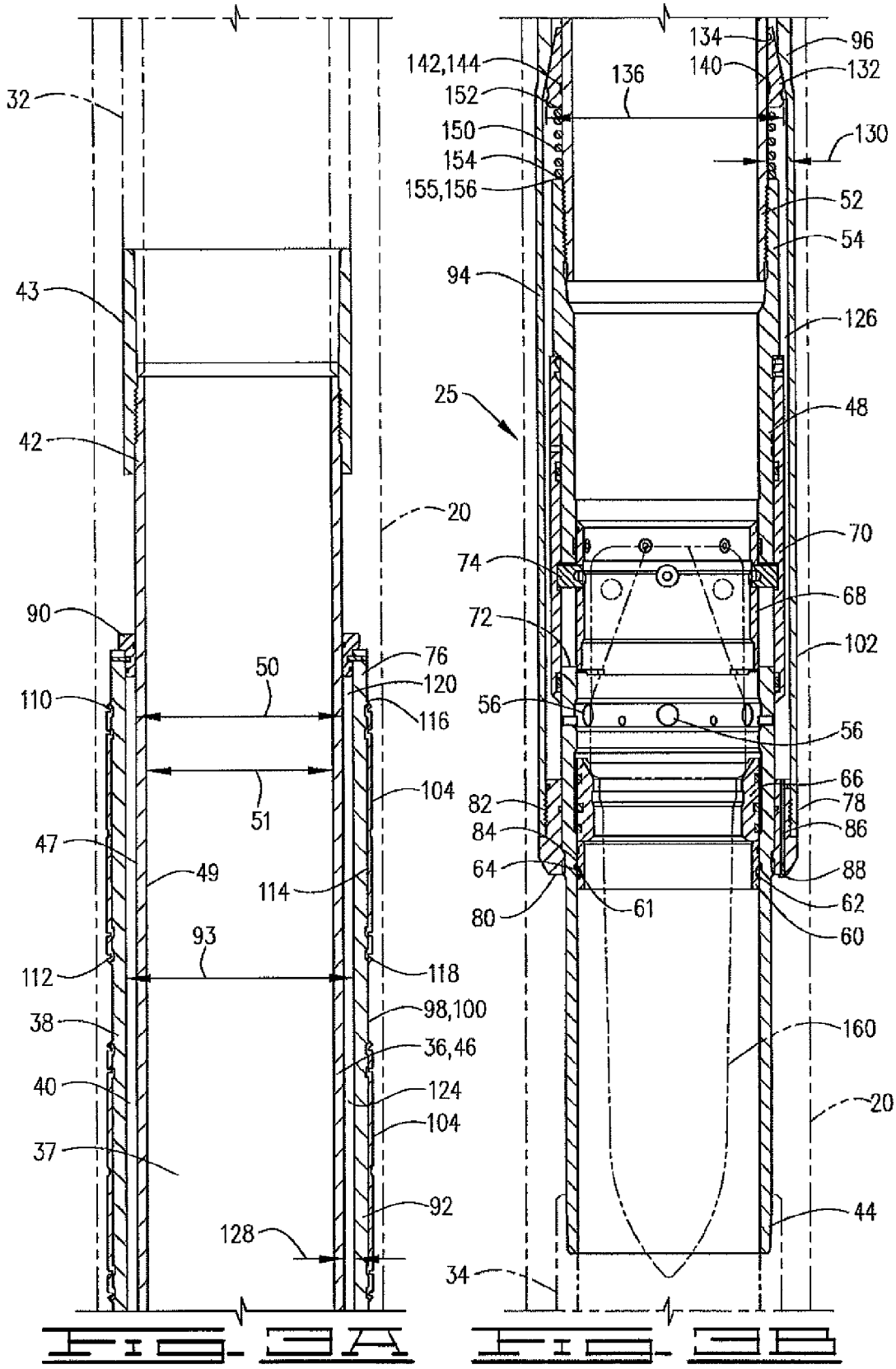
FIG. 3 is a cross section of the tool after the opening sleeve has moved.
Figures 4A, 4B:
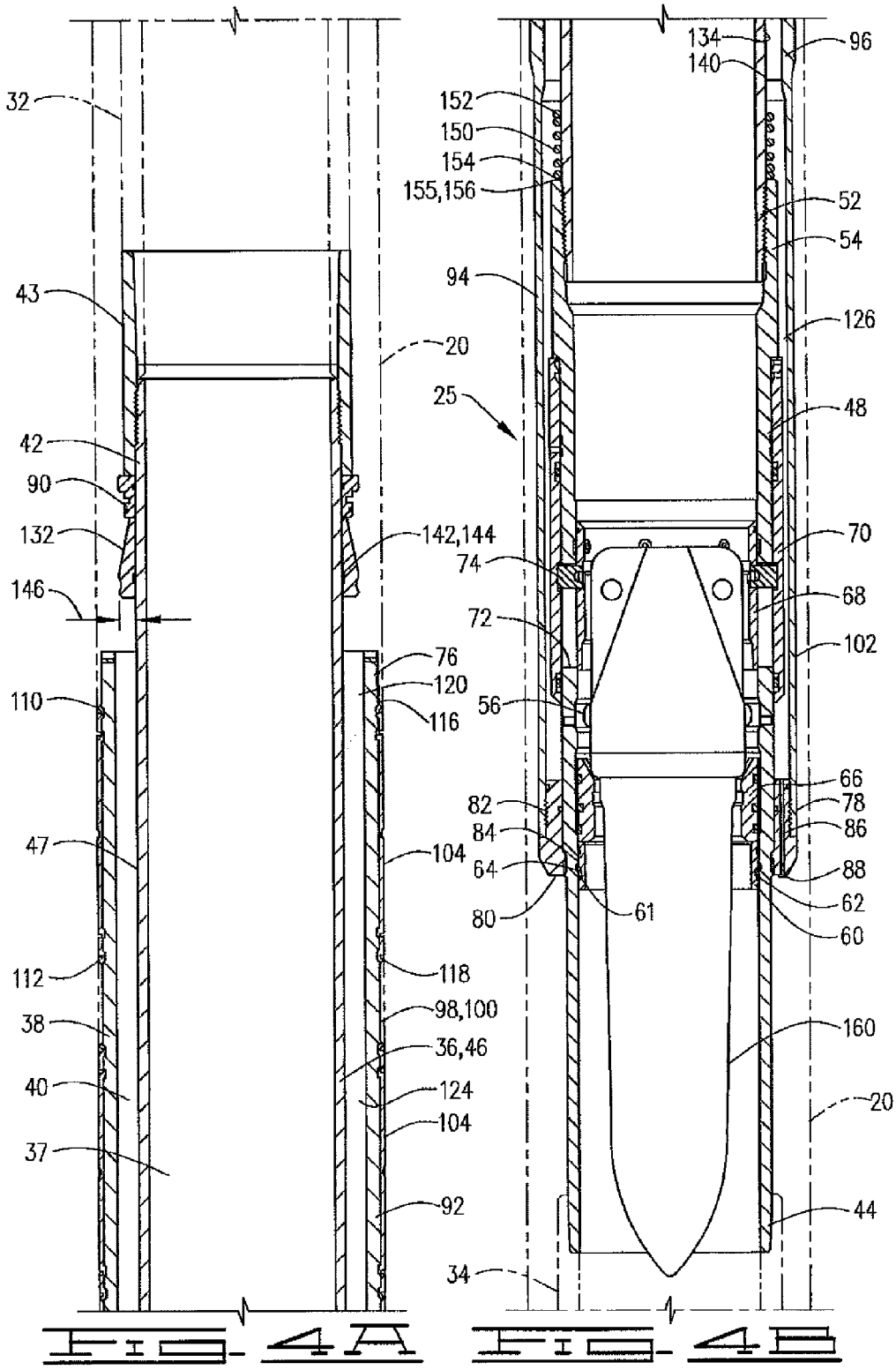
FIG. 4 is a cross section of the tool with the outer mandrel expanded.

The operation of cementing tool 25 is as follows. Tool 25 is lowered into the well 10 on casing 30. It will be understood that the lower end of casing 30 (not shown) will have float equipment such as a float collar or float shoe on an end thereof. Cement will be flowed therethrough to fill the annulus between wellbore 15 and lower casing portion 32. Preferably, cement is flowed therethrough so that it will fill the annulus until it reaches a point above upper end 120 of annular space 40. Once the desired amount of cement has been flowed through a lower end of lower portion 34 of casing 30, a plug, such as for example plug 160 can be displaced into casing 30 so that it will engage opening sleeve 66. Plug 160 is shown in phantom lines in FIG. 3B so that other details of the cementing tool 25 may be clearly seen and described. FIGS. 3A and 3B show tool 25 after plug 160 has been dropped but prior to the time expansion cone 132 is urged through annular space 40. Plug 160 is depicted with a solid line in FIG. 4B. Plug 160 may be displaced through casing 10 with a circulation fluid of a type known in the art. Fluid pressure is increased until shear pins that connect opening sleeve 66 to inner mandrel 36 break. As shown in FIG. 3B, once the shear pins break, sleeve 66 will move in inner mandrel 36 to uncover fluid ports 56. Circulation fluid is displaced through central flow passage 37 and is communicated into annular space 40. As shown in the drawings, fluid is communicated through flow ports 56 into the lower portion 126 of annular space 40 so that it will apply pressure to expansion cone 132. Pressure is increased so that expansion cone 132 will be urged upwardly through the upper portion 124 of annular space 40. As the expansion cone 132 moves through upper portion 124 of annular space 42, it will radially expand outer mandrel 38 and more specifically will radially expand the upper portion 92 thereof.

As explained herein, the outermost diameter 136 of expansion cone 132 is greater than the undeformed inner diameter 93 of the upper portion 92 of outer mandrel 38. As the expansion cone 132 is forced upwardly through the upper portion 124 of annular space 40, outer mandrel 38 will radially expand. Expansion cone 132 is configured such that it will plastically deform outer mandrel 38 an amount sufficient to move sealing elements 104 into engagement with previously installed casing 20. Top and bottom rings 116 and 118 will likewise engage previously installed casing 20. Top and bottom rings 116 and 118 will act as extrusion limiters with respect to sealing elements 104. Fluid pressure applied through flow passage 37 and fluid ports 56 into annular space 40 will urge expansion cone 132 out the upper end 120 of annular space 40. Expansion cone 132 will push debris plug 90 away from upper end 120 of annular space 40, so that fluid may be circulated therethrough. Fluid will continue to be circulated through upper end 120 to wash out the leading edge of cement previously displaced into well 10. Cement will be displaced through the central flow passage 37 and flow ports 56 behind the circulation fluid until a sufficient amount has been displaced into the well to cement casing 30 and more specifically to cement the upper portion 32 thereof in previously installed casing 20.

In one embodiment outer mandrel 38 is fabricated from an alloy steel having a minimum yield strength of about 40,000 to 125,000 psi in order to optimally provide high strength and ductility. Examples of alloy steels that may be used are 4130 and 4140 alloy steels selected to have characteristics that will provide for radial expansion and plastic deformation without tearing or splitting. Material strengths and thicknesses are selected to provide performance (burst and collapse) required for specific well conditions. The thicknesses and relationships between the upper and lower portions of outer mandrel 38 and expansion cone diameter are balanced to achieve the proper contact stress with the casing 20 for pressure containment. Other alloys that may be used include Super 13Cr and Inconel ®825. The examples herein are not limiting and other materials with characteristics that will provide for plastic deformation and proper sealing may be selected.

It will be seen therefore, that the present invention is well adapted to carry out the ends and advantages mentioned, as well as those inherent therein. While the presently preferred embodiment of the apparatus has been shown for the purposes of this disclosure, numerous changes in the arrangement and construction of parts may be made by those skilled in the art. All of such changes are encompassed within the scope and spirit of the appended claims.

What is claimed is:

1. A cementing tool for cementing a casing in a well comprising:

an inner mandrel defining a central flow passage and having at least one fluid port through a wall thereof;

an outer mandrel disposed about the inner mandrel, the inner and outer mandrels defining an annular space therebetween, the annular space terminating at an upper end of the outer mandrel to thus form an upper end of the annular space;

at least one sealing element disposed about the outer mandrel;

an opening sleeve positioned in the inner mandrel movable from a closed position, in which the opening sleeve covers the at least one fluid port to an open position in which the at least one fluid port is not covered by the opening sleeve, and an expansion cone positioned in the annular space between the inner mandrel and outer mandrel wherein fluid pressure communicated through the at least one fluid port from the central flow passage will force the expansion cone through at least a portion of the annular space to cause the outer mandrel to plastically deform radially outwardly so that the at least one sealing element engages the well and the fluid pressure will expel the expansion cone through the upper end of the annular space so that cement may be displaced through the central flow passage, the fluid port and the annular space into the well to cement at least a portion of the casing.

2. The cementing tool of claim 1, the annular space having first and second portions, wherein fluid communicated through the fluid port will force the expansion cone through the first portion of the annular space to deform a first portion of the outer mandrel so that the at least one sealing element attached to the outer mandrel will engage the well.

3. The cementing tool of claim 1, the annular space comprising an upper portion and a lower portion, wherein the expansion cone separates the upper portion from the lower portion.

4. The cementing tool of claim 3, further comprising a spring in the annular space wherein the spring urges the expansion cone toward the upper portion of the annular space.

5. The cementing tool of claim 1, further comprising a closing sleeve movable from a first position in which the closing sleeve does not cover the at least one fluid port, to a second position in which the closing sleeve covers the fluid port to prevent flow therethrough.

6. A cementing tool comprising:

an inner mandrel defining a central flow passage and having a fluid port therethrough;

a plastically deformable outer mandrel disposed about the inner mandrel and defining an annular space therebetween, the outer mandrel having an upper end defining an upper end of the annular space;

an opening sleeve movable in the central flow passage from an initial closed position to an open position in which the fluid port is not covered by the opening sleeve; and an expansion cone positioned in the annular space and movable therein upon the application of fluid pressure communicated through the fluid port, wherein movement of the expansion cone in the annular space will radially expand and plastically deform the outer mandrel so that sealing elements fixed to the outer mandrel will engage a well surrounding the cementing tool and wherein the fluid pressure will expel the expansion cone through the upper end of the annular space so that cement may be displaced through the central flow passage, the fluid port and the annular space into the well to cement a liner connected to the cementing tool in the well.

7. The cementing tool of claim 6, further comprising a closing sleeve connected to and movable relative to the inner mandrel for covering the fluid port to prevent flow therethrough after a desired amount of cement has been displaced into the well therethrough.

8. The cementing tool of claim 6, further comprising a debris shield at an upper end of the annular space.

9. The cementing tool of claim 6, further comprising a casing connected to a lower end of the inner mandrel and a casing connected to an upper end of the inner mandrel, wherein the casing connected to the upper end of the inner mandrel is cemented in the well with cement communicated through the annular space into the well.

10. The cementing tool of claim 6, further comprising:

a closing sleeve disposed about the inner mandrel; and an operating sleeve detachably connected in the inner mandrel, wherein movement of the operating sleeve in the mandrel will move the closing sleeve to a closed position to close the fluid port and prevent flow therethrough after a desired amount of cement has been displaced therethrough.

11. A cementing tool for cementing a casing in a well comprising:

an inner mandrel adapted for connecting to a casing at an upper end thereof;

an outer mandrel connected at one end to the inner mandrel, the inner and outer mandrels defining an annular space therebetween, wherein the annular space has an upper end;

at least one sealing element fixed to the outer mandrel;

a fluid port defined through the inner mandrel communicating a flow passage defined by the inner mandrel with the annular space;

an opening sleeve movable from a closed position to an open position to uncover the fluid port upon the application of fluid pressure in the inner mandrel, wherein upon the application of fluid pressure through the fluid port into the annular space the outer mandrel will plastically deform radially outwardly so that the at least one sealing element fixed thereto will sealingly engage a casing previously installed in the well; and an expansion cone in the annular space having a width greater than a width of an upper portion of the annular space wherein movement of the expansion cone through at least a portion of the annular space plastically deforms the outer mandrel and wherein the expansion cone is expelled through the upper end of the annular space by the applied fluid pressure.

12. The cementing tool of claim 11, further comprising a debris plug inserted in the upper end of the annular space.

13. The cementing tool of claim 11 further comprising a spring positioned in the annular space, wherein the spring engages the expansion cone and urges the expansion cone toward the upper portion of the annular space.

14. The cementing tool of claim 11, wherein the expansion cone divides the annular space into the upper portion and a lower portion.

15. The cementing tool of claim 14, wherein movement of the expansion cone through the upper portion of the annular space plastically deforms the outer mandrel.

16. The cementing tool of claim 11, further comprising a closing sleeve in the annular space, the closing sleeve movable from an open position to a closed position in which the closing sleeve covers the fluid port to prevent flow therethrough.

17. A method of cementing a casing in a well comprising:

lowering a cementing tool into the well on the casing;

plastically deforming a portion of the tool so that it engages a previously installed casing in the well by pumping fluid through an inner mandrel into an annular space, which is defined by the inner mandrel and an outer mandrel and terminates at an upper end, wherein an expansion cone disposed in the annular space is moved through the annular space with the fluid pumped through the inner mandrel to plastically deform the outer mandrel;

expelling the expansion cone through the upper end of the annular space by the pumped fluid; and pumping cement through the tool into an annulus between the previously installed casing and the casing used to lower the cementing tool into the well.

18. The method of claim 17, the pumping cement step comprising pumping cement through the annular space into the annulus between the previously installed casing and the casing used to lower the cementing tool into the well.

19. The method of claim 17, the cementing tool comprising at least one sealing element fixed to the outer mandrel, the plastically deforming step comprising plastically deforming the outer mandrel so that the at least one sealing element sealingly engages the previously installed casing.

20. The method of claim 17, the casing comprising:

the casing connected to an upper end of the cementing tool and a lower casing portion connected to a lower end of the cementing tool, the method further comprising:

prior to the plastically deforming step, pumping cement through the lower portion of the casing and into a wellbore below the previously installed casing to cement the lower casing portion in the wellbore.

* * * * *